United States Patent [19]

Koitabashi et al.

[11] Patent Number: 4,514,491

[45] Date of Patent: Apr. 30, 1985

[54] PHOTOSENSITIVE SILVER HALIDE EMULSION

[75] Inventors: Takeo Koitabashi, Sagamihara; Syoji Matsuzaka, Hino; Yuji Hotta, Hachioji; Masatoshi Iwata, Akishima, all of Japan

[73] Assignee: Konishiroku Photo Industry Co., Ltd., Tokyo, Japan

[21] Appl. No.: 374,481

[22] Filed: May 3, 1982

[30] Foreign Application Priority Data

May 6, 1981 [JP] Japan ..... 56-67917

[51] Int. Cl.[3] ..... G03C 1/02

[52] U.S. Cl. ..... 430/567; 430/569

[58] Field of Search ..... 430/567, 569, 603

[56] References Cited

U.S. PATENT DOCUMENTS

| | | | |
|---|---|---|---|
| 2,222,264 | 11/1940 | Nietz et al. | 430/603 |
| 2,448,534 | 9/1948 | Lowe et al. | 430/603 |
| 3,320,069 | 5/1967 | Illingsworth | 430/603 |
| 4,063,951 | 12/1977 | Bogg | 430/567 |
| 4,086,094 | 4/1978 | Shiba et al. | 430/558 |
| 4,150,994 | 4/1979 | Maternaghan | 430/567 |
| 4,184,878 | 1/1980 | Maternaghan | 430/569 |
| 4,221,863 | 9/1980 | Overman et al. | 430/567 |
| 4,266,018 | 5/1981 | Ishiguro et al. | 430/611 |
| 4,307,185 | 12/1981 | Hinata et al. | 430/574 |
| 4,311,781 | 1/1982 | Mifune et al. | 430/264 |
| 4,332,887 | 6/1982 | Gerber | 430/569 |
| 4,353,977 | 10/1982 | Gerber et al. | 430/568 |
| 4,356,257 | 10/1982 | Gerber | 430/569 |

FOREIGN PATENT DOCUMENTS

| | | | |
|---|---|---|---|
| 1335925 | 10/1973 | United Kingdom | 430/567 |

OTHER PUBLICATIONS

Chem. Absts. vol. 60, 8817 abc.

Science et Industries Photographiques, vol. 34, (5-6) 1963, pp. 141-150, Danguy, George.

Photo Korres. 99(8) 1963, pp. 121-125.

*Primary Examiner*—Mary F. Downey

*Attorney, Agent, or Firm*—Finnegan, Henderson, Farabow, Garrett & Dunner

[57] ABSTRACT

A photosensitive silver halide emulsion comprising photosensitive silver halide grains which essentially consists of monodisperse globular-shaped grains. The grains may be prepared by adding a silver halide solvent to a silver halide emulsion containing monodisperse silver halide grains of regular crystal habit at a time between the complete formation of the monodisperse silver halide grains of regular crystal habit and before commencement of chemical sensitization.

6 Claims, No Drawings

PHOTOSENSITIVE SILVER HALIDE EMULSION

The present invention relates to a photosensitive silver halide emulsion, and more particularly to a photosensitive silver halide emulsion having improved photosensitivity, graininess, fog restraint and covering power.

In recent years, requirements for silver halide emulsions have become more severe in the field of photography in view of various photographic characteristics, such as photosensitivity, graininess, sharpness of the image, fog restraint, maximum density, etc.

Consequently, various types of silver halide emulsions have been proposed. For example, a silver iodobromide emulsion containing 0–10 mol% of silver iodide has been well known as a photosensitive emulsion having high photosensitivity. Various methods for preparing such photosensitive emulsions, such as the so-called ammonia method, neutral method or acid method, all of which involve a control of pH and/or pAg of the emulsion; or the single-jet process or double-jet process, both of which involves the control of the mixing, are well known. Based upon this prior art, a number of studies have been made in order to obtain a photosensitive emulsion having further improved photosensitivity, graininess, sharpness of the image, fog restraint and some of the studies have been put to practical use.

In the field of silver iodobromide emulsion, which is one of the main objects of the present invention, various studies have been made not only on the crystal habits of the silver halide grains and the grain size distribution thereof, but also on controlling the distribution of silver iodide inside the silver halide grains.

The most orthodox known approach for attaining the improved photographic characteristics described above, involves an attempt to improve the quantum efficiency of the silver halide crystals. For the purpose of attaining this, knowledge of solid state physics has been introduced and utilized in this field. For example, there has been a study in which such quantum efficiency was theoretically calculated and the influence of the grain size distribution was considered, which is described on page 91 et seq of the preprint of Tokyo Symposium 1980 on the Progress of Photography, entitled "Interaction between Light and Materials for Photographic Applications". According to this study, a prediction was made that it would be effective for the purpose of improving quantum efficiency to prepare an emulsion having narrow grain size distribution, i.e., a monodisperse emulsion. In addition it appeared reasonable to assume that, in order to attain improved photosensitivity of a silver halide emulsion while effectively restraining the occurrence of fog in the chemical sensitization, such a monodisperse emulsion would be advantageous.

However, in practice, only a few systems which employ a monodisperse emulsion either singly or in combination of two or more monodisperse emulsions are known to successfully attain the above-mentioned predicted results. In particular, it may not be too much to say that there is substantially no such silver halide emulsion of negative type having high photosensitivity. The reason for this is considered that even if such a monodisperse emulsion can be prepared and the emulsion is subjected to chemical sensitization by means of a conventional method, the monodisperse silver halide emulsion obtained very often exhibits only inferior photographic characteristics as compared with those obtainable by conventional polydisperse emulsions.

In order to prepare such monodisperse emulsions industrially, as described, for example, in Japanese Patent Publication Open to Public Inspection (hereinafter referred to as Japanese Patent O.P.I. Publication) No. 48521/1979, it is necessary to strictly control the supplying speed of silver ion and halide ion into a reaction system and the agitation of which conditions may be obtainable theoretically, under strict control of pAg and pH. A thus prepared monodisperse silver halide emulsion normally consists of regular crystals of either cubic, octehedron or tetradecahedron of which surface is comprised of either only (100) or (111) surface, or (100) and (111) surfaces at various ratios. The inventors of the present invention have prepared various monodisperse emulsions of the above-mentioned crystal habits, applied thereto conventional chemical sensitization and examined the photographic properties obtainable therefrom. However, the inventors only found that thus prepared monodisperse emulsion could exhibit similar or inferior photographic performance as compared with polydisperse emulsions practically used in this field.

Accordingly, it is the primary object of the present invention to provide a photosensitive silver halide emulsion having improved photographic properties as mentioned above.

Another object of the present invention is to provide a process for the preparation of a photosensitive silver halide emulsion having such improved photographic properties.

Thus, the present invention specifically relates to a photosensitive silver halide emulsion comprising photosensitive silver halide grains which essentially consists of monodisperse globular-shaped grains.

From the results of the inventors' studies on how to obtain photosensitive silver halide emulsions having improved photographic properties, the inventors have found a method for preparing a monodisperse photosensitive silver halide emulsion having improved photographic properties sensitivity of, graininess, fog restraint and covering power in comparison with those obtainable by the use of a polydisperse emulsion of the prior art.

Polydisperse emulsions containing globular shaped grains or so-called potato-shaped grains are well known in the art, however, monodisperse emulsions containing silver halide grains consisting essentially of globular-shaped grains are not known in the art. Specifically, in order to obtain monodisperse globular-shaped grains, so-called Ostwald ripening, which involves a reaction accompanying the dissolution of silver halide grains, is necessary and thus, it has generally been considered that such a process runs counter to the production of the monodisperse emulsions as described, for example, in the afore-mentioned Japanese Patent O.P.I. Publication No. 48521/1979.

It has been predicted from the studies of solid state science that the state of the surface of silver halide grains has various and great effects on the photographic performance of the grains as is described, for example, in "Shashin Kogaku no Kiso: Gin-en Shashin Hen" ("Basis of Photographic Engineering: A Compilation of Silver Salt Photography"), compiled by the Society of Photographic Science and Technology of Japan, on page 52, wherein, however, the properties of the surface which would have advantageous and suitable effects on the photographic performance are not specifically referred to and described.

We have found that the photosensitive silver halide emulsion of the present invention can be prepared by first preparing a monodisperse silver halide emulsion containing silver halide grains consisting essentially of grains having a regular crystal habit according to a known process, e.g., in the manner described in the afore-mentioned Japanese Patent O.P.I. Publication No. 48521/1979, and thereafter adding thereto a silver halide solvent, such as a rhodan salt, ammonia, tetramethylthiourea and the like. Unexpectedly greats effects are obtained by applying to the thus prepared emulsion a conventionally known chemical sensitization such as sulpher sensitization, gold sensitization, selenium sensitization and the like.

In the present invention, the term "photosensitive silver halide grains which essentially consists of monodisperse globular-shaped grains" means any silver halide grains which have substantially globular shape, and at the same time, the grain size distribution thereof is very narrow, and preferably, the grain size distribution satisfies a certain requirement that the ratio of the standard deviation against the average grain size of such grains falls within a certain range.

Since where the configuration and/or the size of the silver halide grains are uniform i.e., in a monodisperse emulsion, the grain size distribution of a silver halide emulsion almost follows the normal distribution, the standard deviation can be obtained easily.

The extent of the grain size distribution is defined in terms of the following equation;

Extent of Grain Size Distribution = (Standard Deviation/Average Grain Size) × 100[%], the extent of the grain size distribution of the silver halide grains is preferably within the range not greater than 15%, and more preferably not greater than 10%.

The term "substantially globular shaped grain" means (1) that when a grain is viewed from the top (i.e., the top plane view of a grain), at least two pairs of opposite corners have round corners, with each pair of the two positions at right angles, and the radius of curvature of the rounded corners is approximately r/6 to r/2 (assuming that when the grain forms a regular square having four corners r equals the length of each side), or (2) that when the grains are coated on a substrate so that each grain is so disposed in orientation as described in "Bulletin of the Society of Scientific Photography of Japan", 13, page 5, such grains have a particular diffraction intensity from its (220) faces relative to its (111) faces in x-ray diffraction of not greater than 8%, and more preferably not greater than 15%.

In the silver halide emulsion of the invention, any of the conventionally known photosensitive silver halides can be incorporated, and preferably, those silver halide emulsions used for high speed photography, e.g., AgBr, AgBrI and AgClBrI, and most preferably, AgBrI containing AgI at an amount of not higher than 10 mol % can be incorporated.

To prepare the silver halide emulsions of the invention, it suffices for preparing such emulsion to prepare a monodisperse silver halide emulsion normally crystallized comprising cube grains formed by [100] face, regular octahedral grains formed by [111] face or tetradecahedral grains formed by both [100] face and [111] face and adding thereto a silver halide solvent such as a rhodan salt, ammonia, a thiourea (e.g., tetramethylthiourea), or thioether at an arbitrary point of time between the completion of forming the silver halide grains of said emulsion and the commencement of chemical ripening.

As for a process for preparing a monodisperse emulsion, there is preferably given a process, wherein a silver halide emulsion of which the core grains are monodisperse silver halide grains is used and said core grains are coated over with shells and thus monodisperse silver halide emulsions having the approximately uniform thickness of said shells are obtainable.

A photosensitive silver halide emulsion of the invention may be doped with any one of various kinds of metallic salts or metallic complex salts at the time of producing a precipitation of silver halide, at the time of growing the grains or after the completion of the growing. For example, it is possible to apply a metallic salt or a complex salt of gold, platinum, palladium, iridium, rhodium, bismuth, cadmium, copper and the like, or a combination thereof.

It is also allowable to remove excessive haloid compounds or bi-produced or unnecessary nitrates, salts of ammonia etc., and compounds which are produced in preparing an emulsion of the invention. As for the removing processes, there can be suitably used a noodle wash process, a dialysis process, a coagulation precipitation process or the like for ordinary type emulsions.

Emulsions of the invention can be applied by a variety of chemical sensitization processes which are applied to of ordinary type of emulsions. Said chemical sensitizations can be performed by the chemical sensitizers, namely, an active gelatin; a noble metal sensitizer such as a water-soluble gold salt, a water-soluble platinum salt, a water-soluble palladium salt, a water-soluble rhodium salt or a water-soluble iridium salt; a sulphur sensitizer; a selenium sensitizer; and a reduction sensitizer such as polyamine and stannous chloride; independently or in combination thereof. Said silver halide can further be optically sensitized in a desired wavelength range. There is no particular limitation to the optical sensitization process for an emulsion of the invention, thus it is possible to optically sensitize the emulsion (e.g., a hypersensitization) by making independent use of or in combination with the optical sensitizers of a cyanine dye such as zeromethine dye, monomethine dye, dimethine and trimethine dye or those of a merocyanine dye. U.S. Pat. Nos. 2,688,545, 2,912,329, 3,397,060, 3,615,635 and 3,628,964; British Patent Nos. 1,195,302, 1,242,588 and 1,293,862; W. German Patent (OLS) Nos. 2,030,326 and 2,121,780; Japanese Patent Examined Publication Nos. 4936/1968 and 14030/1969; and others have described the said technology. It is possible to arbitrarily determine the selection of the wavelength range and the photosensitivity in accordance with the purposes and the usage of such photosensitive materials.

A monodisperse silver halide emulsion of the invention is also allowed to be used, as the granurality distributions thereof are, or by blending not less than two kinds of monodisperse emulsions of different average grain diameters at an arbitrary time after grain formation so that a given gradation may be achieved by mixing each other. Besides, said emulsions include those containing other types of silver halide grains than those of the invention provided that the effects of the invention are disturbed.

The emulsions of the invention can contain a variety of additives being usually used according to the purposes thereof. Examples of such additives are a stabilizer or an antifoggant such as azaindenes, triazoles, tetrazoles, an imidazolium salt, a tetrazolium salt and a polyhydroxy compound; a hardening agent such as those of aldehydes, azylidines, isoxazoles, vinylsulfones, acryloyls, carbodimidos, maleimides, an ester methansulfonate, and triazines; a development accelerator such as benzyl alcohol and a polyoxyethylene compound; an image stabilizer such as those of chromans, coumarans, bisphenols, and an ester phosphite; a lubricant such as a wax, a glyceride of higher fatty acid, and higher alcohol esters of higher fatty acid. The emulsions can also be used with an anionic, cationic, non-ionic or amphoteric agent of various kinds to serve as the permeation improving agent for a coating assistant or a processing liquid as to a surface active agent, the deforming agent or a basic material for controlling a variety of the physical properties of a photosensitive material. The effective antistatic agents are alkaline salts obtained from the reactants of diacetyl cellulose, styrene-perfluoroalkyl sodium maleate copolymer, styrene-maleic acid anhydrous copolymer and p-aminobenzene sulfonic acid. As for a matting agent, methyl polymethacrylate, polystyrene, an alkaline soluble polymer and the like can be given. Colloidal silicon oxide is further possible to use. As for a latex to be added for improving the physical properties of a layer, there can be given the examples such as the copolymers of an ester acrylate, a vinyl ester and the like and a monomer having other ethylene groups. As for a gelatin plasticizer, there can be given the examples such as glycerol and a glycol compounds, and as for a thickening agents, styrenesodium maleate copolymer, alkylvinylethermaleic acid copolymer and the like.

As for the supports for the photosensitive materials to be prepared with the emulsions of the invention prepared as above, there are given the examples such as a baryta paper, a polyethylene coated paper, a polypropylene synthetic paper, a glass, cellulose acetate, cellulose nitrate, polyvinyl acetal, polypropylene, a polyester film of polyethyleneterephthalate and the like; said supports can suitably be selected in accordance with the purposes of using each silver halide photosensitive material.

Such supports are coated with a subbing layer as occasion demands.

The emulsions of the invention can effectively be applied to the photosensitive materials for a variety of photographic usages for ordinary black-and-white, X-ray, color, infrared, micrography, silver dye bleach process, reversal, diffusion tranfer process and the like.

To obtain the characteristics of which the latitude is wide with an emulsion of the invention, monodisperse emulsions are mixed together of which at least two kinds of the average grain diameters are different from each other or of which the sensitivities are different from each other, or the multilayer coating is applied thereon, and thus it is possible to obtain a photosensitive material having a high optical density, that is, the satisfactorily wide latitude, the less coated amount of silver resulted by the characteristics of the emulsion of the invention and the high covering power.

To apply an emulsion of the invention onto a photosensitive material for color photographic use, it suffices to employ a conventional method and the basic materials used for a color photosensitive material such as those in which cyan, magenta and yellow couplers are combinedly contained in an emulsion of the invention which have been controlled red-, green- and blue-sensitivity.

For a yellow coupler, an open-chained ketomethylene coupler which has been publicly known can be used, such as benzoylacetanilide compounds and pivaloyl acetanilide compounds.

For magenta couplers, a pyrazolone compound, an indazolone compound, a cyanoacetyl compound and the like can be used, and for cyan couplers, a phenol compound, a naphthol compound and the like can be used.

The photosensitive materials prepared by making use of the emulsions of the invention can be developed after exposure by conventional known methods.

The black-and-white developers are alkaline solutions containing a developing agent such as a hydroxybenzene, an aminophenol, an aminobenzene, which may also contain sulfites, carbonates, hydrogensulfites, bromides and iodides of an alkali metal salt. In the case that said photosensitive material is for color photographic use, it is possible to color develop it by a usual color developing method. In a reversal developing method, the development is made at first with a black-and-white developer and a white light exposure is then applied thereto, or, the processing is made with a bath containing an antifoggant and a color development is further made with an alkaline developer containing a color developing agent. With respect to the processing methods thereof, there is no specific limitation but any one of them can be applied, for the typical examples, they can be applied respectively by the process in which a bleach-fix process is made after a color development and further a washing and a stabilizing process are made as occasion demands, or by the process in which a bleaching process and a fixing process are made independently after a color development and further a washing and a stabilizing process are made as occasion demands.

The present invention will be apparent from the concrete description and examples which follow, and it is however to be understood that the invention is not limited thereto.

EXAMPLE 1

Three types of monodisperse cubic-crystal emulsions were prepared in the process disclosed in Japanese Patent Publication Open to Public Inspection No. 48521/1979. Two of the emulsions, a and b were respectively 1.2$\mu$ in average grain diameter and comprised silver iodobromide containing 1.5 mol% of silver iodide, and emulsion c was of 1.2$\mu$ in average grain diameter and comprised pure silver bromide. Emulsion a was a silver iodobromide emulsion covered with a silver bromide shell (of which the thickness was 0.2$\mu$), while said emulsion b was a silver iodobromide emulsion without any silver bromide shell. Then, each of the 3 kinds of the emulsions were divided into two parts, one of which was desalted of an excess amount of salts therefrom to serve as the control example. These desalted control samples were named as a, b and c, respectively; and to each of the other parts was added 100 mg/l of ammonium thiocyanate, agitated at 60° C. for 30 minutes and then desalted as in the cases of the control examples. These emulsions were respectively the monodisperse ones in globular shape and named as emulsion A, B and C, respectively. Each of the above six kinds of emulsions was applied with gold and sulphur sensitization which were considered the most suitable, and completed to ripen, and then to each was added 4-hydroxy-6-methyl-1,3,3a,7-tetrazaindene.

Thereafter to each said emulsion was added popular additives for photographic use such as a spreading agent, a thickening agent and a hardening agent and then silver was coated on the both sides of a sublayered polyethylene terephthalate substratum so that the amount of the silver could be at the ratio of 50 mg/100 $cm^2$, and thus each of Sample No. 1–6 were prepared by drying said coated material, respectively.

The sensitometry of said samples was measured as follows: An exposure was made for 1/50 second by making use of a light source of 5,400° K. through an optical wedge. The exposure amount was 3.2 CMS on each side of a sample. The development was made with the following developer at 35° C. for 30 seconds.

| | |
|---|---|
| Sodium sulphite, anhydrous | 70 g |
| Hydroquinone | 10 g |
| Boric acid | 1 g |
| Sodium carbonate, monohydrate | 20 g |
| 1-phenyl-3-pyrazolidone | 0.35 g |
| Sodium hydroxide | 5 g |
| 5-methyl-benzotriazole | 0.05 g |
| Potassium bromide | 5 g |
| Glutaraldehyde bisulfite | 15 g |
| Glacial acetic acid | 8 g |
| Add water to make | 1 ltr. |

The results thereof are shown in Table 1. The sensitivity thereof is shown by the relative sensitivity to the sensitivity of Sample 1 that is taken for 100. In the table, reference character S represents a sensitivity, and Fog represents a fog density.

TABLE 1

| Sample Nos. | Emulsion | S | Fog | Distribution Range* | Grain configuration |
|---|---|---|---|---|---|
| 1 | a | 100 | 0.04 | 8 | Cube |
| 2 | b | 60 | 0.04 | 8 | " |
| 3 | c | 50 | 0.04 | 8 | " |
| 4 | A The invention | 160 | 0.03 | 8.5 | Globular shape |
| 5 | B The invention | 70 | 0.04 | 8.5 | " |
| 6 | C The invention | 65 | 0.04 | 9 | " |

(Note)
*Distribution Range = Standard Deviation/Average Grain Diameter × 100

As is obvious from the above results, every monodisperse emulsion of A, B and C of the present invention has a greater sensitivity than the control monodisperse emulsions a, b and c. Particularly to such emulsions as emulsion a, it is remarkable in the sensitization effects.

EXAMPLE 2

Emulsions d and D of 4 mol% of iodine were prepared by a similar process to that of Example 1. The emulsion d was a cubic crystal monodisperse emulsion for control use, wherein the after-processing was not applied with ammonium thiocyanate. Thus prepared emulsions were applied by the gold and the sulphur sensitization for which the chemically ripening time was varied into double-standards as shown in Table 2. Each of the emulsions was green-sensitized by making use of an ortho sensitizing dye, then 15 g of 1-(2,4,6-trichlorophenyl)-3-[3-(2,4-di-t-amylphenoxyacetoamide)-benzamide]-5-pyrazolone as a coupler were dissolved in the mixture of 30 ml of ethyl acetate and 15 ml of dibutyl phthalate, and the solution thus obtained was mixed in 20 ml of 10% solution of Alkanol B (alkyl naphthalene sulfonate—mfd. by Du Pont) and 200 ml of 5% gelatin solution. The mixture thus obtained was dispersively emulsified by a colloid mill, the matter thus obtained was added to 1 kg of aforesaid emulsion, the mixture obtained was coated over a triacetate substratum so that the amount of silver could be at the ratio of 20 mg/$dm^2$, the samples were dried, and samples No. 7–10 were thus prepared.

TABLE 2

| Sample Nos. | Emulsion Used | Chemical Ripening Time |
|---|---|---|
| 7 | d | 60′ |
| 8 | d | 80′ |
| 9 | D | 60′ |
| 10 | D | 80′ |

The above-mentioned four samples were exposed to light through a wedge, color-developed for three minutes at 38° C. by making use of the color developer described below, washed after the bleaching and the fixing were made, and the sensitivity and the fog were thus measured. The results thereof are shown in Table 3.

| (Composition of Color Developer) | |
|---|---|
| 4-amino-3-methyl-N—ethyl-N—(β-hydroxyethyl)-aniline. sulfate | 4.75 g |
| Sodium sulfite, anhydrous | 4.25 g |
| Hydroxyamine ½ sulfate | 2.0 g |
| Potassium carbonate, anhydrous | 37.5 g |
| Sodium bromide | 1.3 g |
| Nitrilotriacetic acid. 3 sodium salt (monohydrate) | 2.5 g |
| Potassium hydroxide | 1.0 g |

Add water to make 1 liter and adjust the pH at 10.0 by making use of potassium hydroxide.

TABLE 3

| Sample Nos. | Sensitivity | Fog |
|---|---|---|
| 7 The control | 68 | 0.3 |
| 8 The control | 100 | 0.5 |
| 9 The invention | 105 | 0.2 |
| 10 The invention | 150 | 0.4 |

(Note) Each density was measured by green-light. Each sensitivity was indicated by a relative sensitivity to that of Sample 2 that was taken as 100.

As is obvious from the above results, Samples No. 9 and 10 are apparently superior in the sensitivity and the fog in comparison with Control samples No. 7 and 8.

EXAMPLE 3

The monodisperse emulsion in octahedron was prepared while the pAg was kept at 9.5 by a similar process to that of Example 1. Silver iodide in the emulsion was at 4 mol% in the silver iodobromide emulsion and the thickness of the silver bromide shell was 0.2μ which was similar to the one of the emulsion a in Example 1. The emulsion thus prepared is hereby referred to as emulsion e.

A part of said emulsion e was divided into two parts; to one part was added tetramethylthiourea at a concentration of 50 mg/l, which was then agitated for 30 minutes at 60° C., followed by a desalting process. The emulsion thus prepared was the globular monodisperse emulsion that is hereby referred to as emulsion E. The two emulsions were made green-photosensitive by applying the most suitable sulphur and gold sensitization and by making use of an ortho sensitizing dye. Next, by a similar process to that taken in Example 2, to each of the emulsions was added magenta couplers, the matter thus obtained was coated over a triacetate stratum, and thus Samples No. 11 and 12 were prepared, respectively.

TABLE 4

| Sample Nos. | Emulsion Used | Grain Diameter | Distribution Range | Grain Configuration |
|---|---|---|---|---|
| 11 | e | 0.8 μ | 8 | Octahedron |
| 12 | E | 0.8 μ | 9 | Globe |

Each sample given in the above Table 4 was exposed to light and developed, and then the sensitivity and the fog thereof were measured. The results thereof are shown in Table 5.

TABLE 5

| Sample Nos. | Sensitivity* | Fog |
|---|---|---|
| 11 | 100 | 0.05 |
| 12 | 230 | 0.06 |

*The above sensitivity is the relative sensitivity to that of Sample No. 11 that is taken as 100.

As is obvious from Table 5, the globular monodispersible emulsions of the invention are remarkably superior to an octahedron monodisperse emulsion, in the sensitization effects. The effects of applying the surface treatment of the invention to an octahedron emulsion are greater than those on the surface treatments applied to each of the cubic emulsions exemplified in Examples 1 and 2.

EXAMPLE 4

An emulsion was prepared containing a core/shell type grain comprising a core made of silver iodobromide containing 2 mol% of silver iodide and a shell made of silver bromide, through the conventional process described in Japanese Patent Publication No. 1417/1976. The average grain diameter thereof was 1.2μ, and the distribution range was 35%. (The emulsion thus obtained is hereby referred to as emulsion F.) Emulsion F was a polydisperse emulsion of which the grains were potato shaped.

This emulsion was ripened, an additive was added, coated and then dried, and thus Sample No. 13 was prepared similarly to Example 1.

Two kinds of cubic monodisperse emulsions of the average diameters of 1.0μ and 0.5μ, respectively, each of which comprised cores of silver iodobromide containing 2 mol% of silver iodide and shells of silver bromide of which the average thickness was 0.03μ, (the distribution ranges thereof were at 8% each) were prepared. The emulsions were processed with ammonium thiocyanate by the same process taken in Example 1.

As a result therefrom, globular monodisperse emulsions G and H having the average grain sizes of 1.0μ and 0.5μ and the distributions of 8% and 8.5%, respectively, were obtained, and thereafter to each of the emulsions was applied the most suitable chemical ripening.

Said emulsions G and H were mixed at the ratio by weight of silver halide thereof, G:H=7:3 to prepare emulsion I, and said emulsion I was prepared by a similar process to that described in the case of Example 1, was then coated, and thus Sample No. 14 was obtained.

The sensitometry and the development thereof was carried out in a similar manner to that of Example 1. The results are shown in Table 6.

TABLE 6

| Sample Nos. | Emulsion | S | Fog | γ | CP | Granularity (RMS)* |
|---|---|---|---|---|---|---|
| 13 | F (Conventional process) | 100 | 0.04 | 3.4 | 38 | 0.10 |
| 14 | I (G:H = 7:3) The invention | 100 | 0.03 | 3.5 | 50 | 0.07 |

(Note)
CP represents a covering power
γ represents a latitude
*The RMS was measured in such a manner that an acryl plate of 10 cm in thickness was placed in front of a photosensitive material interposed between two sheets of intensifying screen to irradiate an X-ray for such a period of time so that the image density of both surfaces of the material could be at 1.0 after the processes, respectively, under the aforementioned conditions, and then the emulsion layer of the material facing the front side of an X-ray generating means was peeled off and the emulsion surface on the other side was measured at the magnification ratio of 5 × 10 and in the aperture size of 50 μφ by means of Sakura one-touch type RMS measuring instrument (mfd. by Konishiroku Photo Ind. Co., Ltd., Japan).

As is obvious from Table 6, of the two kinds of samples which have similar degrees of photosensitivity and latitude, it has been found that Sample No. 14 of the invention is far superior in the covering power and the granularity.

We claim:

1. A photosensitive silver halide emulsion comprising photosensitive silver halide grains which essentially consist of monodisperse globular-shaped grains, wherein the ratio of the standard deviation to the average grain size of said monodisperse globular-shaped grains contained in the emulsion is not more than 0.15.

2. A photosensitive silver halide emulsion according to claim 1, wherein said silver halide is AgBr, AgBrI or AgClBrI.

3. A photosensitive silver halide emulsion according to claim 1, wherein said monodisperse globular-shaped grain is prepared by adding a silver halide solvent to a silver halide emulsion containing monodisperse silver halide grains having a regular crystal habit at a time between the completion of formation of the monodisperse silver halide grains having regular crystal habits and before the commencement of chemical sensitization.

4. A photosensitive silver halide emulsion according to claim 3, wherein said silver halide grains have a regular crystal habit of cubic, octahedron, or tetradecahedron shape.

5. A photosensitive silver halide emulsion according to claim 1, wherein said ratio is not more than 0.10.

6. A photosensitive silver halide emulsion according to claim 2, wherein said silver halide is AgBrI, said AgBrI containing AgI in an amount not higher than 10 mol%.

* * * * *